US011278854B2

(12) United States Patent
Saint et al.

(10) Patent No.: US 11,278,854 B2
(45) Date of Patent: Mar. 22, 2022

(54) FLUID AGITATING DEVICE EQUIPPED WITH SUCH AN AGITATING DEVICE

(71) Applicant: FILLON TECHNOLOGIES, Faverolles (FR)

(72) Inventors: Patrick Saint, Chartres (FR); Antonio Greco, Nice (FR); Philippe Barbero, Nice (FR)

(73) Assignee: FILLON TECHNOLOGIES, Faverolles (FR)

( * ) Notice: Subject to any disclaimer, the term of this patent is extended or adjusted under 35 U.S.C. 154(b) by 105 days.

(21) Appl. No.: 16/626,897

(22) PCT Filed: Jun. 18, 2018

(86) PCT No.: PCT/FR2018/051438
§ 371 (c)(1),
(2) Date: Dec. 27, 2019

(87) PCT Pub. No.: WO2019/012197
PCT Pub. Date: Jan. 17, 2019

(65) Prior Publication Data

US 2020/0129935 A1 Apr. 30, 2020

(30) Foreign Application Priority Data

Jul. 10, 2017 (FR) ..... 17 56520

(51) Int. Cl.
*B22C 5/00* (2006.01)
*B01F 7/16* (2006.01)
(Continued)

(52) U.S. Cl.
CPC ..... *B01F 7/1695* (2013.01); *B01F 27/0727* (2022.01); *B01F 27/091* (2022.01);
(Continued)

(58) Field of Classification Search
CPC ..... B01F 2215/005; B01F 7/00175; B01F 7/00208; B01F 7/00275; B01F 7/00558; B01F 7/1695; B44D 3/08; B44D 3/127
See application file for complete search history.

(56) References Cited

U.S. PATENT DOCUMENTS 778,614 A 12/1904 Wellman
1,095,749 A 5/1914 Tomlinson
(Continued)

FOREIGN PATENT DOCUMENTS

EP 2 014 351 1/2009
EP 2014351 A1 * 1/2009 ..... B01F 7/1695
(Continued)

OTHER PUBLICATIONS

English Machine Translation of the Description of EP2014351A1 labeled as "EP2014351A1_mt_desc_eng" (Year: 2009).*
(Continued)

*Primary Examiner* — Anshu Bhatia
*Assistant Examiner* — Gregory Y Huan
(74) *Attorney, Agent, or Firm* — Ipsilon USA, LLP

(57) ABSTRACT

The invention relates to an agitating device (1) comprising a stirring shaft (2) that is vertically positionable in a use configuration, a stirring element comprising a circular ring portion (7) partially surrounding the agitating shaft (2), this ring portion, in the use configuration of the shaft (2), being disposed in a plane that is inclined with respect to the shaft (2) and develops around the shaft (2) from the lower end (8) thereof in the direction of the upper end (9) thereof, following an ascending slope, this ring portion (7) being hollow and provided with openings (11) for communicating with the outside and means (4) for connecting the stirring element and the shaft (2). These connecting means (4) comprise at least one arm (12) that is radial to the agitating shaft (2) and
(Continued)

connects the lower end (5) of the agitating shaft (2) and the lower end (8) of the stirring element, and extends at least partially in a plane perpendicular to the agitating shaft (2).

15 Claims, 6 Drawing Sheets

(51) Int. Cl.

| | |
|---|---|
| ***B44D 3/08*** | (2006.01) |
| ***B44D 3/12*** | (2006.01) |
| ***B01F 27/091*** | (2022.01) |
| ***B01F 27/118*** | (2022.01) |
| ***B01F 27/072*** | (2022.01) |
| ***B01F 27/1123*** | (2022.01) |
| *B01F 101/30* | (2022.01) |

(52) U.S. Cl.
CPC ..... *B01F 27/118* (2022.01); *B01F 27/1123* (2022.01); *B44D 3/08* (2013.01); *B44D 3/127* (2013.01); *B01F 2101/30* (2022.01)

(56) References Cited

U.S. PATENT DOCUMENTS

| | | | | |
|---|---|---|---|---|
| 2,579,874 | A | 12/1951 | Shaw | |
| 2,778,614 | A * | 1/1957 | Koch | B01F 7/166 415/8 |
| 4,610,068 | A * | 9/1986 | Schultz | B01F 7/00391 29/418 |
| 5,073,033 | A * | 12/1991 | Klepeis | B01F 7/003 366/343 |
| 5,358,153 | A | 10/1994 | Caldwell | |
| 2004/0037163 | A1 | 2/2004 | Weber | |
| 2006/0097093 | A1 | 5/2006 | Hockmeyer | |

FOREIGN PATENT DOCUMENTS

| | | |
|---|---|---|
| EP | 2014451 | 1/2009 |
| SU | 997 772 | 2/1983 |

OTHER PUBLICATIONS

International Search Report dated Mar. 23, 2018.
Japanese Office Action dated Jan. 25, 2022.

* cited by examiner

FLUID AGITATING DEVICE EQUIPPED WITH SUCH AN AGITATING DEVICE

RELATED APPLICATION

This application is a National Phase of PCT/FR2018/051438 filed on Jun. 18, 2018, which claims the benefit of priority from French Patent Application No. 17 56520 filed on Jul. 10, 2017, the entirety of which are incorporated by reference.

FIELD OF THE INVENTION

The invention relates to a device for agitating fluid, such as paint, contained inside a receptacle, such as a can, and also to a lid of a receptacle equipped with such an agitating device.

It relates more particularly to a device for agitating fluid comprising an agitating shaft that can be driven in rotation, a stirring element and means for linking between the stirring element and the agitating shaft, the agitating shaft being positionable from its lower end in the direction of its upper end vertically, in the use configuration, and the stirring element comprising a circular ring portion arranged around the agitating shaft, this ring portion being, in the vertical position of the agitating shaft corresponding to the use configuration, arranged in a plane that is inclined relative to the agitating shaft and developing about the agitating shaft from one of the "lower" ends thereof in the direction of the other "upper" end thereof, following an ascending slope, this ring portion forming, in the manner of an annular cage, a hollow ring portion provided with openings for communication between its cavity and the exterior.

PRIOR ART

Numerous devices for agitating paint exist, as illustrated by patents EP 2 014 351, FR 2 704 453 or DE 20 205 449. These agitating devices are inefficient when agitating a product of which a part accumulates by settling-out in the bottom of the container. Resuspending the result of the settling-out generally requires manual intervention prior to the actual agitating operation.

OBJECTS AND SUMMARY

An object of the invention is thus to propose an agitating device of the aforesaid type, the design of which makes it possible to obtain a homogeneous mixture, including in the case of products that tend to settle out.

A further object of the present invention is to propose an agitating device of the aforesaid type, the design of which allows easy manufacture.

To that end, a subject of the invention is a device for agitating fluid, such as paint, contained inside a receptacle, such as a can, said device comprising an agitating shaft that can be driven in rotation, a stirring element and means for linking between the stirring element and the agitating shaft, the agitating shaft being positionable from its lower end in the direction of its upper end vertically, in the use configuration, and the stirring element comprising a circular ring portion partially surrounding the agitating shaft, this ring portion being, in the vertical position of the agitating shaft corresponding to the use configuration, arranged in a plane that is inclined relative to the agitating shaft and developing about the agitating shaft from one of the "lower" ends thereof in the direction of the other "upper" end thereof, following an ascending slope, this ring portion forming, in the manner of an annular cage, a hollow ring portion provided with openings for communication between its cavity and the exterior, characterized in that the means for linking between the agitating shaft and the stirring element comprise at least one arm that is radial relative to the agitating shaft arranged between the lower end of the agitating shaft and the lower end of the stirring element and connecting said lower ends together, this radial arm, which is capable of acting as a scraper and called the lower linking arm, extending at least partially in a plane perpendicular to the agitating shaft.

Producing the stirring element in the form of a ring portion and not a complete ring facilitates insertion and removal of the stirring element from the receptacle, such as a can, without causing splashing. The presence of an arm that can act as a scraper enables the agitating device to be satisfactorily efficient, including in the case of products that tend to produce a considerable amount of settling-out residues. The inclined ring portion/scraper arm combination allows improved homogenization of the stirred fluid.

According to an embodiment of the invention, the lower linking arm takes the form of a blade having, taken relative to the direction of rotation of the agitating shaft, a front longitudinal or leading edge, a rear longitudinal edge, said front and rear longitudinal edges are connected together via two faces forming, respectively, the faces of the top and of the bottom of the blade, in the use configuration of the agitating shaft, the front longitudinal edge of the blade extends in a plane perpendicular to the agitating shaft, and the face of the top of the blade forms an inclined surface with a descending slope from the rear longitudinal edge toward the front longitudinal edge.

The form of the face of the top of the blade constituting the lower linking arm allows the fluid to rise in the direction of the ring.

Preferably, the face of the top of the blade constituting the lower linking arm is concave.

According to an embodiment of the invention, the means for linking between the agitating shaft and the stirring element comprise, in addition to the lower linking arm, at least one supplementary arm that is radial relative to the agitating shaft.

According to an embodiment, the or at least one of the supplementary shafts take the form of a blade having, taken relative to the direction of rotation of the agitating shaft, a front longitudinal or leading edge, a rear longitudinal edge, said front and rear longitudinal edges are connected together via two faces forming, respectively, the faces of the top and of the bottom of the blade, in the use configuration of the agitating shaft, and the face of the top of the blade forms an inclined surface with a descending slope from the rear longitudinal edge toward the front longitudinal edge.

By virtue of this arrangement, the mechanical strength of the device is high but not to the detriment of the homogeneity of the resulting mixture.

According to an embodiment of the invention, the or each of the supplementary arms is offset axially along the agitating shaft relative to the lower linking arm.

According to an embodiment of the invention, the or one of the supplementary arms is arranged between the agitating shaft and the upper end of the ring portion of the stirring element.

Preferably, the lower end of the ring portion has, in the zone of connection thereof to the lower linking arm, a trough portion forming a ramp.

According to an embodiment of the invention, the ring portion is formed from two concentric parallel circle portions, partially surrounding the agitating shaft, these two circle portions, of different radii, being connected together by half-rings each extending in a plane that is radial relative to the agitating shaft.

It is thereby possible easily to manufacture, by molding the agitating device, circle and half-ring portions forming, in a simple manner, the equivalent of a spiral.

According to an embodiment of the invention, the half-rings are organized in two series, extending, respectively, one above the plane passing via the two circle portions, the other below the plane passing via the two circle portions, in the use configuration of the agitating shaft.

Preferably, the half-rings are offset axially along the circle portions from one series of half-rings to the other series of half-rings.

According to an embodiment of the invention, the stirring element, the means for linking between the stirring element and the agitating shaft and at least a part of the agitating shaft are made as a single piece.

According to an embodiment, the ring portion develops between the lower end thereof and the upper end thereof over at least 90°, preferably 180°.

According to an embodiment, the angular sector formed by the ring portion is within the range 90°-270°.

A further subject of the invention is a lid of a receptacle for receiving fluid, said lid being provided with a device for agitating fluid, characterized in that the device for agitating fluid is of the aforesaid type.

BRIEF DESCRIPTION OF THE DRAWINGS

The invention will be better understood upon reading the following description of exemplary embodiments, with reference to the appended drawings, in which.

DETAILED DESCRIPTION

Figure 1:
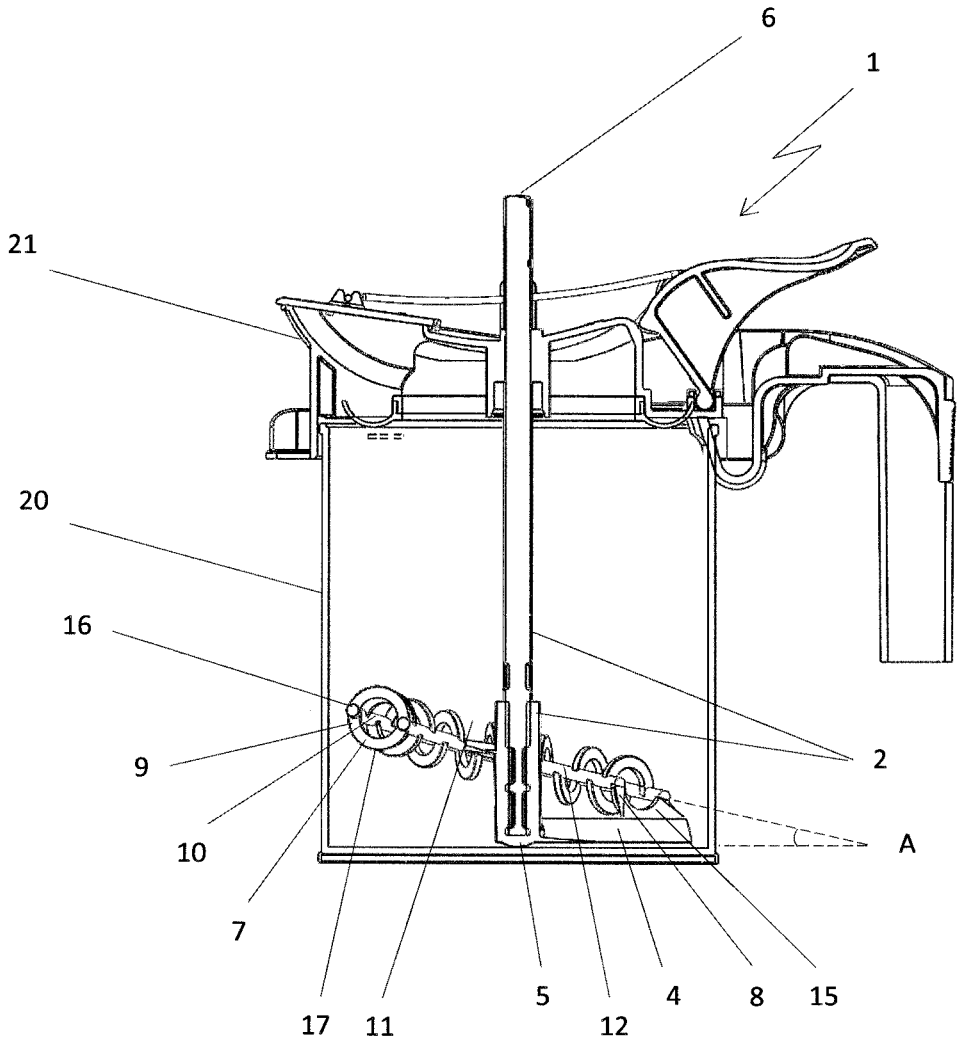
FIG. 1 shows a sectional view of a receptacle provided with a lid equipped with an agitating device according to the invention.
Figure 2:
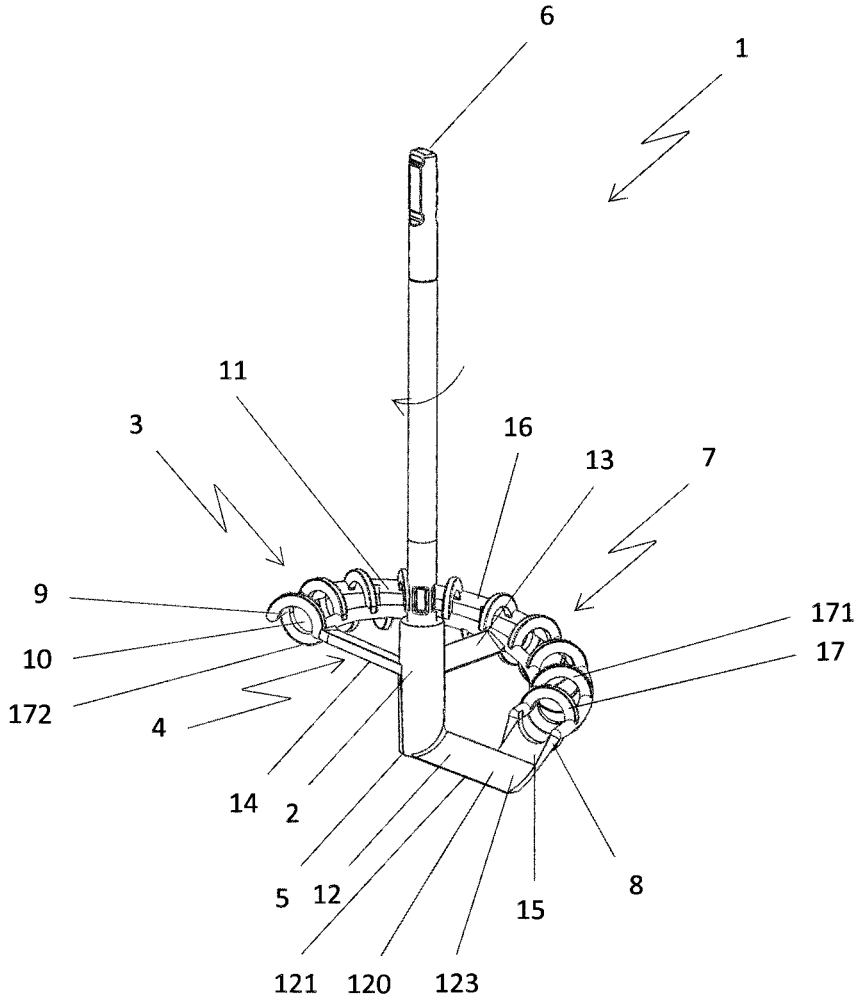
FIG. 2 shows a perspective view of the agitating device on its own.
Figure 3:
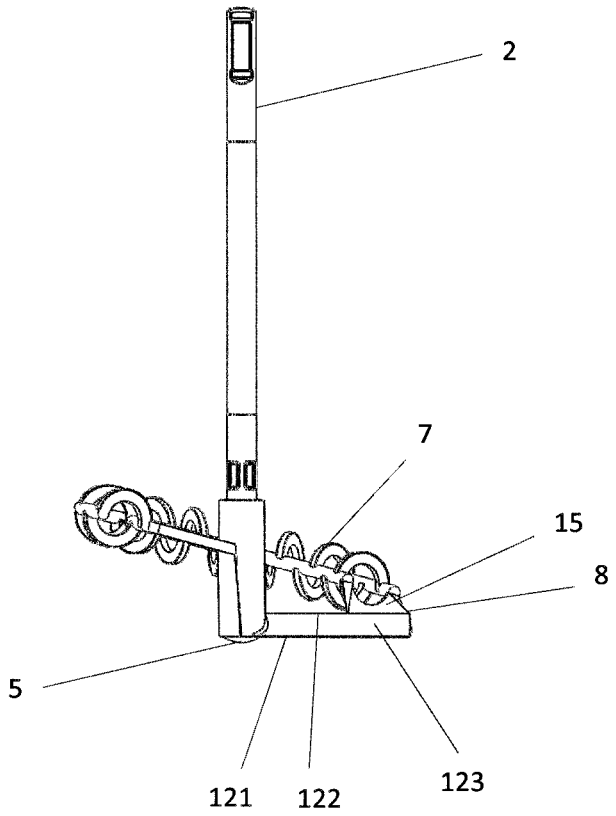
FIG. 3 shows a front view of an agitating device according to the invention.
Figure 4:
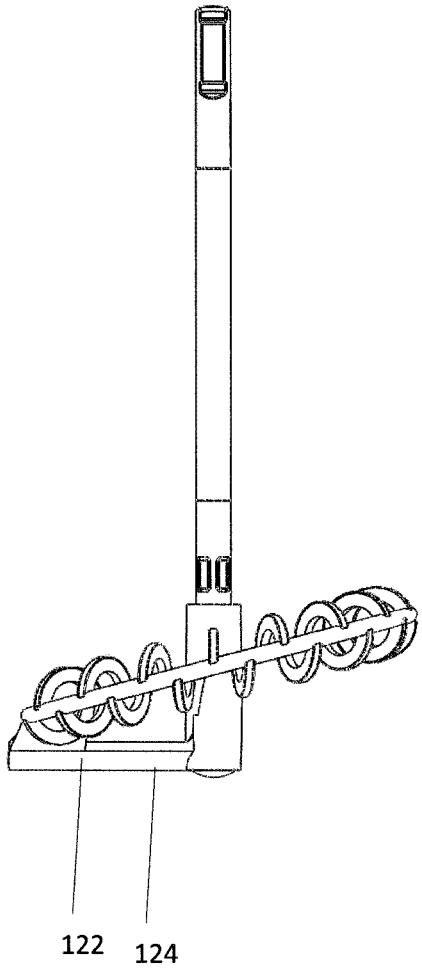
FIG. 4 shows a rear view of an agitating device according to the invention.
Figure 5:
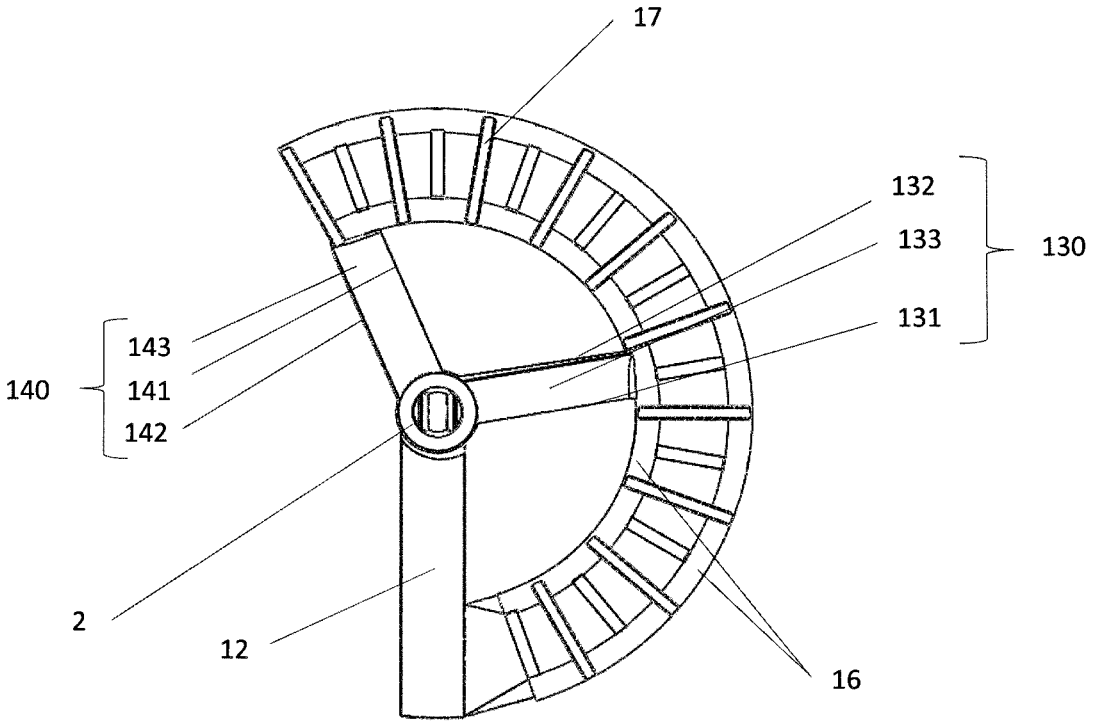
FIG. 5 shows a top view of an agitating device according to the invention.
Figure 6:
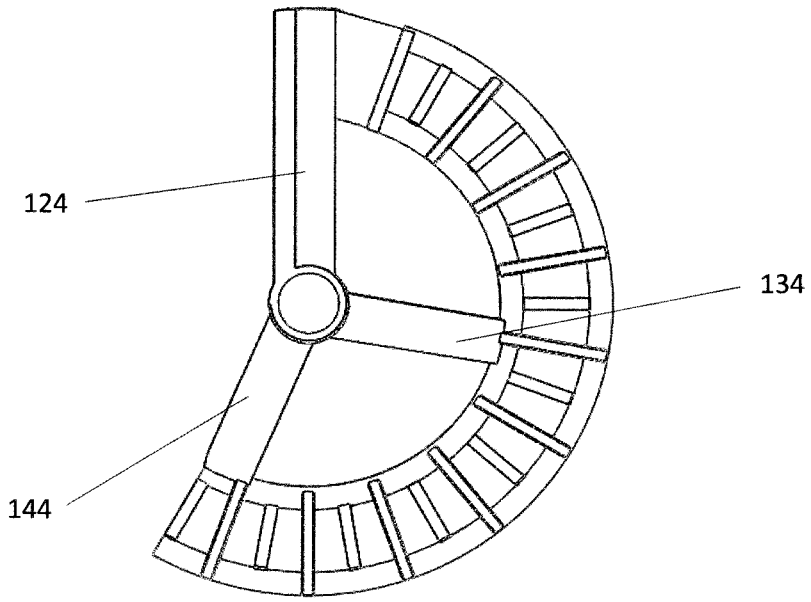
FIG. 6 shows a bottom view of an agitating device according to the invention.
Figure 7:
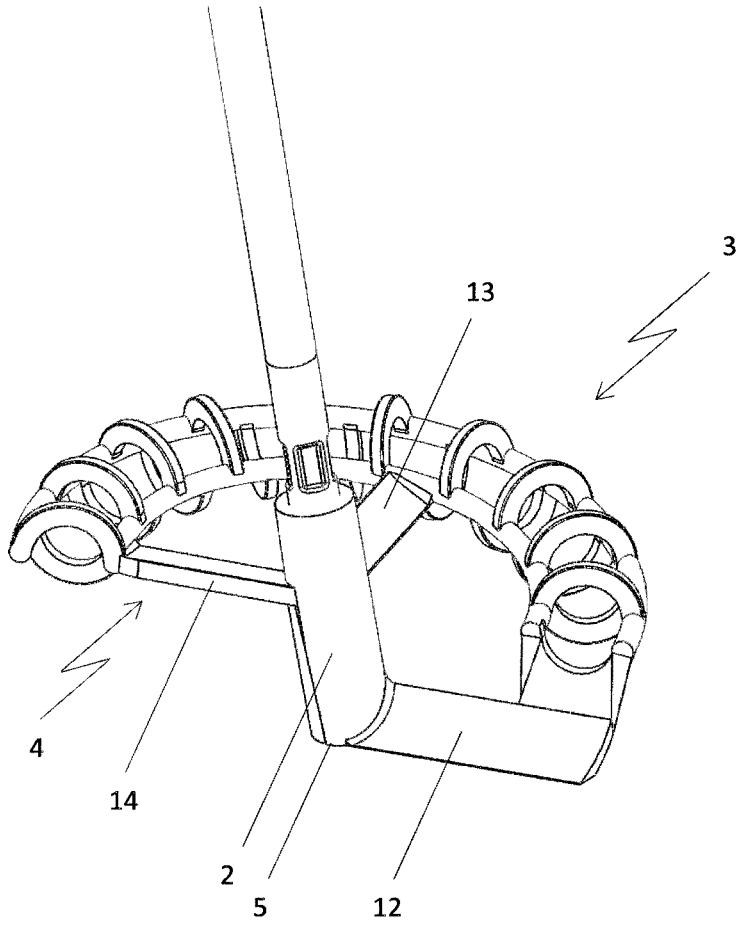
FIG. 7 shows a perspective partial view of an agitating device according to the invention.

As mentioned above, a subject of the invention is a device 1 for agitating fluid, in particular liquid, more particularly suitable for agitating paint stored inside a receptacle 20, such as a can, which is closed by a lid 21, the agitating device 1 projecting at least partially from the lid 21.

This agitating device 1 comprises an agitating shaft 2 that can be driven in rotation, in particular turned on itself, a stirring element 3 and means 4 for linking between the stirring element 3 and the agitating shaft 2, the agitating shaft 2 being positionable from its lower end 5 in the direction of its upper end 6 vertically, in the use configuration, i.e. generally perpendicularly to the face forming the base of the receptacle 20.

The agitating shaft 2 may be driven in rotation in a diverse and varied manner, depending on the environment in which the agitating device 1 is arranged. Thus, the agitating shaft 2 may be coupled to a driving head equipping a paint can agitating cabinet. This agitating shaft 2 may alternatively be coupled to the drive shaft of a tool, such as a drill or the like.

When this agitating shaft 2 equips the lid 21 of a receptacle 20, as illustrated in FIG. 1, the agitating shaft 2 traverses a through-opening in the lid and the upper end of the agitating shaft 2 is arranged above the lid, in order to engage with means for driving said shaft in rotation, while the lower end 5 of the agitating shaft 2, the stirring element 3 and the means 4 for linking between the stirring element 3 and the agitating shaft 2 are arranged below the lid 21, inside the receptacle 20.

The stirring element 3 comprises a circular ring portion 7 partially surrounding the agitating shaft 2. This ring portion 7 is, in the vertical position of the agitating shaft 2 corresponding to the use configuration, arranged in a plane that is inclined relative to the agitating shaft 2. In other words, the circumferential plane of the ring portion 7 passing via the lower 8 and upper 9 ends of the portion 7 forms, with a plane perpendicular to the agitating shaft 2, an angle A generally between 5° and 45°, preferably around 15°. This ring portion 7 takes the general form of a torus portion, which is open in the center, the surface of the torus being perforated. This ring portion 7 develops between the lower end 8 thereof and the upper end 9 thereof over at least 90°, preferably 180°. Preferably, the angular sector formed by the ring portion 7 is in the range 90°-270°.

In the examples shown, this ring portion 7 thus forms, in the manner of an annular cage, a hollow torus or hollow ring portion of circular cross section provided with openings 11 for communication between its cavity 10 and the exterior. In particular, in the example shown, the ring portion 7 is formed from two concentric parallel circle portions 16, partially surrounding the agitating shaft 2, these two circle portions 16, of different radii, being connected together by half-rings 17 each extending in a plane that is radial relative to the agitating shaft 2. The half-rings 17 are organized in two series 171, 172, extending, respectively, one 171 above the plane passing via the two circle portions 16, the other 172 below the plane passing via the two circle portions 16, in the use configuration of the agitating shaft 2. The half-rings 17 are offset axially along the circle portions 16 from one series of half-rings to the other series of half-rings.

The half-rings 17 of one series are, in the examples shown, separated from one another by a constant pitch. Each intermediate half-ring 17 of a series, i.e. formed by a half-ring other than the end half-rings of the series, is arranged facing the space left free between two successive half-rings of the other series of half-rings. Thus, the half-rings 17 extend from the lower end 8 of the ring portion 7 in the direction of the upper end 9 of the ring portion 7, alternately below and above the plane passing via the circle portions 16.

This particular arrangement confers on the half-ring assembly a form close to a spiral form, without presenting the difficulties of demolding a spiral. It is thereby possible to produce the stirring element 3, the means 4 for linking between the stirring element 3 and the agitating shaft 2 and at least a part of the agitating shaft 2 as a single piece.

The openings 11 for communication with the exterior of the ring portion 7 are thus formed by the space left free between two successive half-rings of a series of rings.

The means 4 for linking between the agitating shaft 2 and the stirring element 3 comprise at least one arm 12 that is radial relative to the agitating shaft 2 arranged between the lower end 5 of the agitating shaft 2 and the lower end 8 of the stirring element 3.

This radial arm 12 connects the lower ends of the agitating shaft and of the stirring element together. This radial arm 12, which can act as a scraper and is called the lower linking arm 12, extends at least partially in a plane perpendicular to the agitating shaft 2. This arrangement makes it possible in effect to treat the material that has accumulated by settling-out at the base of the receptacle and to prevent such an accumulation of material, which would be detrimental to the homogeneity of the mixture.

In the examples shown, the lower linking arm 12 takes the form of a blade 120 having, taken relative to the direction of rotation of the agitating shaft 2, a front longitudinal or leading edge 121, a rear longitudinal edge 122 and two transverse edges. One of the transverse edges of the blade constitutes the edge linking the blade to the lower end of the agitating shaft 2. The lower end 8 of the ring portion 7 is, meanwhile, connected to the blade 120 constituting the lower linking arm 12, at the rear longitudinal edge or longitudinal trailing edge 122 of said blade 120.

The blade 120 thus extends in front of the lower end 8 of the ring portion 7 taken relative to the direction of rotation of the agitating shaft 2. This blade 120 extends as far as the external peripheral edge of the ring portion 7.

In the example shown, the front 121 and rear 122 longitudinal edges of the blade 120 are connected together via two faces forming, respectively, the faces of the top 123 and of the bottom 124 of the blade 120, in the use configuration of the agitating shaft 2.

The front longitudinal edge 121 of the blade 120 extends in a plane perpendicular to the agitating shaft 2, and the face of the top 123 of the blade 120 forms an inclined surface with a descending slope from the rear longitudinal edge 122 toward the front longitudinal edge 121 of the blade 120.

Furthermore, in the example shown, the face of the top 123 of the blade 120 constituting the lower linking arm 12 is concave. In a variant, the latter could have been planar. Generally, the faces of the bottom and of the top of the blade are parallel to one another.

This inclined configuration of the blade facilitates the removal of material and the guiding thereof toward the ring portion 7.

To improve this guiding, the lower end 8 of the ring portion 7 has, in the zone of connection thereof to the lower linking arm 12, a trough portion 15 forming a ramp.

To reinforce the mechanical strength of the device and to improve the quality of the mixture in terms of homogeneity, the means 4 for linking between the agitating shaft 2 and the stirring element 3 comprise, in addition to the lower linking arm 12, at least one supplementary arm that is radial relative to the agitating shaft.

The or at least one of the supplementary arms is an "upper" radial arm 14. This upper radial arm is arranged between the upper end 9 of the ring portion 7 and the agitating shaft 2.

In the example shown, two supplementary arms, shown respectively at 13 and 14, are provided. One of the arms, shown at 14 in the figures, takes the form of a blade 140 having, taken relative to the direction of rotation of the agitating shaft 2, a front longitudinal edge 141 and a rear longitudinal edge 142. These front 141 and rear 142 longitudinal edges are connected together via two faces forming, respectively, the faces of the top 143 and of the bottom 144 of the blade 140, in the use configuration of the agitating shaft, and the face of the top 143 of the blade 140 forms an inclined surface with a descending slope from the rear longitudinal edge toward the front longitudinal edge 141.

The radial arm shown at 13 in the figures also takes the form of a blade 130 having, taken relative to the direction of rotation of the agitating shaft, a front longitudinal or leading edge 131 and a rear longitudinal edge 132. Said front 131 and rear 132 longitudinal edges are connected together via two faces forming, respectively, the faces of the top 133 and of the bottom 134 of the blade 130 in the use configuration of the agitating shaft 2, and the face of the top 133 of the blade forms an inclined surface with a descending slope from the rear longitudinal edge 132 toward the front longitudinal edge 131 of the blade 130.

This supplementary radial arm 13 extends, here, equidistantly from the lower 12 and upper 14 arms. The supplementary arms 13 and 14 extend at least partially in the mid or circumferential plane of the ring portion 7, passing via the lower and upper ends of said portion. The face of the top of the blades constituting the supplementary arms may be planar, i.e. rectilinear, or concave. Generally, the faces of the bottom and of the top of the blades are parallel to one another.

Such an agitating device 1 operates in a similar manner to a conventional agitating device. To allow agitation of the contents of a receptacle using such an agitating device, it suffices to insert the agitating device into the receptacle, ideally until the lower end of the agitating shaft 2 rests against the base of the receptacle, as illustrated in FIG. 1, then to drive said agitating shaft 2 in rotation, the lower end of the ring portion being the leading end.

To prevent premature wear of the lower end 5 of the agitating shaft 2 and of the base of the receptacle 20, this lower end 5 is preferably spherical, as illustrated in the figures.

The invention claimed is:

1. A device for agitating fluid, such as paint, contained inside a receptacle, such as a can, said device comprising:

an agitating shaft that can be driven in rotation, a stirring element and means for linking between the stirring element and the agitating shaft, the agitating shaft being positioned vertically when in use, and the stirring element comprising a circular ring portion partially surrounding the agitating shaft, this ring portion, as the agitating shaft is positioned vertically, being arranged in a plane that is inclined relative to the agitating shaft and developing about the agitating shaft from one of the "lower" ends thereof in the direction of the other "upper" end thereof, following an ascending slope, this ring portion forming, in the manner of an annular cage, a hollow ring portion provided with openings for communication between its cavity and the exterior, wherein the means for linking between the agitating shaft and the stirring element comprise at least one arm that is radial relative to the agitating shaft arranged between the lower end of the agitating shaft and the lower end of the stirring element and connecting said lower ends together, this radial arm, which is capable of acting as a scraper and called the lower linking arm, extending at least partially in a plane perpendicular to the agitating shaft, and wherein the ring portion is formed from two concentric parallel circle portions, partially surrounding the agitating shaft, these two circle portions, of different radii, being connected together by half-rings each extending in a plane that is radial relative to the agitating shaft.

2. The device as claimed in claim 1, wherein the lower linking arm takes the form of a blade having, taken relative to the direction of rotation of the agitating shaft, a front longitudinal or leading edge, a rear longitudinal edge, in that said front and rear longitudinal edges are connected together via two faces forming, respectively, the faces of the top and of the bottom of the blade, the agitating shaft in the vertical position, in that the front longitudinal edge of the blade extends in a plane perpendicular to the agitating shaft, and in that the face of the top of the blade forms an inclined surface with a descending slope from the rear longitudinal edge toward the front longitudinal edge.

3. The device as claimed in claim 2, wherein the face of the top of the blade constituting the lower linking arm is concave.

4. The device as claimed in claim 1, wherein the means for linking between the agitating shaft and the stirring element comprise, in addition to the lower linking arm, at least one supplementary arm that is radial relative to the agitating shaft.

5. The device as claimed in claim 4, wherein the at least one of the supplementary arms take the form of a blade having, taken relative to the direction of rotation of the agitating shaft, a front longitudinal or leading edge, a rear longitudinal edge, in that said front and rear longitudinal edges are connected together via two faces forming, respectively, the faces of the top and of the bottom of the blade, in the use configuration of the agitating shaft, and in that the face of the top of the blade forms an inclined surface with a descending slope from the rear longitudinal edge toward the front longitudinal edge.

6. The device as claimed in claim 4, wherein the at least one of the supplementary arms is offset axially along the agitating shaft relative to the lower linking arm.

7. The device as claimed in claim 4, wherein the or one of the supplementary arms is arranged between the agitating shaft and the upper end of the ring portion of the stirring element.

8. The device as claimed in claim 1, wherein the lower end of the ring portion has, in the zone of connection thereof to the lower linking arm, a trough portion forming a ramp.

9. The device as claimed in claim 1, wherein the half-rings are organized in two series, extending, respectively, one above the plane passing via the two circle portions, the other below the plane passing via the two circle portions, in the use configuration of the agitating shaft.

10. The device as claimed in claim 1, wherein the half-rings are offset axially along the circle portions from one series of half-rings to the other series of half-rings.

11. The device as claimed in claim 1, wherein the stirring element, the means for linking between the stirring element and the agitating shaft and at least a part of the agitating shaft are made as a single piece.

12. The device as claimed in claim 1, wherein the ring portion develops between the lower end thereof and the upper end thereof over at least 90°, preferably 180°.

13. The device as claimed in claim 1, wherein the angular sector formed by the ring portion is within the range 90°-270°.

14. A lid of a receptacle for receiving fluid, said lid being provided with a device for agitating fluid, wherein the device for agitating fluid is as claimed in claim 1.

15. The device as claimed in claim 12, wherein the ring portion develops between the lower end thereof and the upper end thereof over at least 180°.

* * * * *